US006357478B1

(12) United States Patent
Campbell et al.

(10) Patent No.: US 6,357,478 B1
(45) Date of Patent: Mar. 19, 2002

(54) SUCTION FLOW REGULATOR

(75) Inventors: Sanford Campbell; Suresh Cherulassery Gopalan, both of Redding, CA (US)

(73) Assignee: Letro Products, Inc., Redding, CA (US)

( * ) Notice: Subject to any disclaimer, the term of this patent is extended or adjusted under 35 U.S.C. 154(b) by 0 days.

(21) Appl. No.: 09/690,316

(22) Filed: Oct. 17, 2000

(51) Int. Cl.[7] ..... F16K 11/02
(52) U.S. Cl. ..... 137/605; 251/340; 15/1.7
(58) Field of Search ..... 137/605, 893; 251/340, 351; 15/1.7

(56) References Cited

U.S. PATENT DOCUMENTS 2,891,572 A * 6/1959 Clark ..... 251/351
4,550,748 A * 11/1985 Nunez ..... 137/605
5,363,877 A * 11/1994 Frentzel et al. ..... 137/526
6,098,228 A * 8/2000 Chang ..... 15/1.7
6,112,354 A * 9/2000 Stoltz et al. ..... 15/1.7

* cited by examiner

*Primary Examiner*—John Fox
(74) *Attorney, Agent, or Firm*—Vierra Magen Marcus Harmon & DeNiro LLP

(57) ABSTRACT

A suction control regulator for a suction cleaner, comprising: a y-shaped housing having an inlet and an outlet, and a regulator section; a valve mount positioned in the regulator section; a valve having a stem adapted to be received in the valve mount; a window in the regulator section; and a cap having a tapered bore engaging the valve, and a threads adapted to engage the regulator section such that rotation of the cap seals or opens the window and the tapered bore.

15 Claims, 3 Drawing Sheets

SUCTION FLOW REGULATOR

BACKGROUND OF THE INVENTION

1. Field of the Invention

This invention relates generally to the field of automatic swimming pool cleaners, and more particularly, to an apparatus for controlling suction in a suction cleaner.

2. Description of the Related Art

A swimming pool normally includes a water filtration system for removing dirt and debris from the pool water. Such filtration systems typically include a circulation pump which is installed outside the swimming pool and a piping system for coupling the circulation pump to the swimming pool. The circulation pump draws water from the swimming pool for delivery through the piping system to a filter unit.

One or more baskets are located in the piping system upstream from the filter unit to catch larger debris, such as leaves and the like; the filter unit functions to separate dirt and fine debris from the water. The water is then re-circulated by the pump back to the swimming pool.

However, a conventional water filtration system is not designed to remove silt and debris which tends to settle irrespective of size onto the floor and sidewalls of a swimming pool. To address this problem, automatic swimming pool cleaners for cleaning the floor and sidewalls of a swimming pool are well known.

There are generally four types of pool cleaners in the pool cleaning market: pressure or return side cleaners; suction cleaners; electric cleaners and in-floor cleaners.

While pressure or return side cleaners are extremely effective, they can be somewhat costly and many models require a separate booster pump to operate effectively. Suction side cleaners are generally cheaper in cost, connect to the pool's skimmer and utilize the sucking action of the water being drawn from the pool by the filter pump to vacuum debris. These cleaners do not sweep, nor do they employ a collection bag, as demonstrated by U.S. Pat. No. 5,001,600 (Parenti, et al.) and copending U.S. patent application Ser. No. 09/662,260 entitled SUCTION CLEANER, Inventors Sanford Campbell, Suresh Gopalan, filed Sep. 15, 2000. Instead, debris vacuumed by the suction side cleaners is deposited in the skimmer or pump basket, while sand and silt that is small enough to pass through the skimmer is captured in the pool's filter.

When using a suction type cleaner, there may be instances when performance of the cleaner can be enhanced by adjusting the amount of suction to the cleaner to optimize movement and performance of the cleaner in its environment.

SUMMARY OF THE INVENTION

The invention, roughly described, comprises a suction control valve which can be advantageously used as a water control valve for a suction cleaning apparatus. In one aspect, the suction control valve includes an inlet and an outlet, and a suction regulator coupled between the inlet and the outlet. The suction regulator includes a regulator housing having an opening, a cylindrical valve in the regulator housing, and an adjustable housing cover capable of completely covering the opening. In one particular aspect, the housing cover includes a separate bore which is sealable by the cylindrical valve.

In a further aspect, the water control valve comprises a Y-shaped valve housing having an inlet, an outlet and a regulator tube. A window is positioned on the regulator tube and a regulator mount is positioned in the regulator tube. A valve having a generally conical shape with a tapered end and a mount post positioned opposite the tapered end is provided in the regulator mount. A regulator cap having a bore receiving the tapered end of the valve is also provided.

BRIEF DESCRIPTION OF THE DRAWINGS

The invention will be described with respect to the particular embodiments thereof. Other objects, features, and advantages of the invention will become apparent with reference to the specification and drawings in which.

DETAILED DESCRIPTION

A suction regulator for a suction cleaner for pools, spas and the like is hereinafter described. The regulator includes multiple water inlets to provide a large degree of water flow regulation with a minimal amount of movement in the regulation controller.

Figure 1:
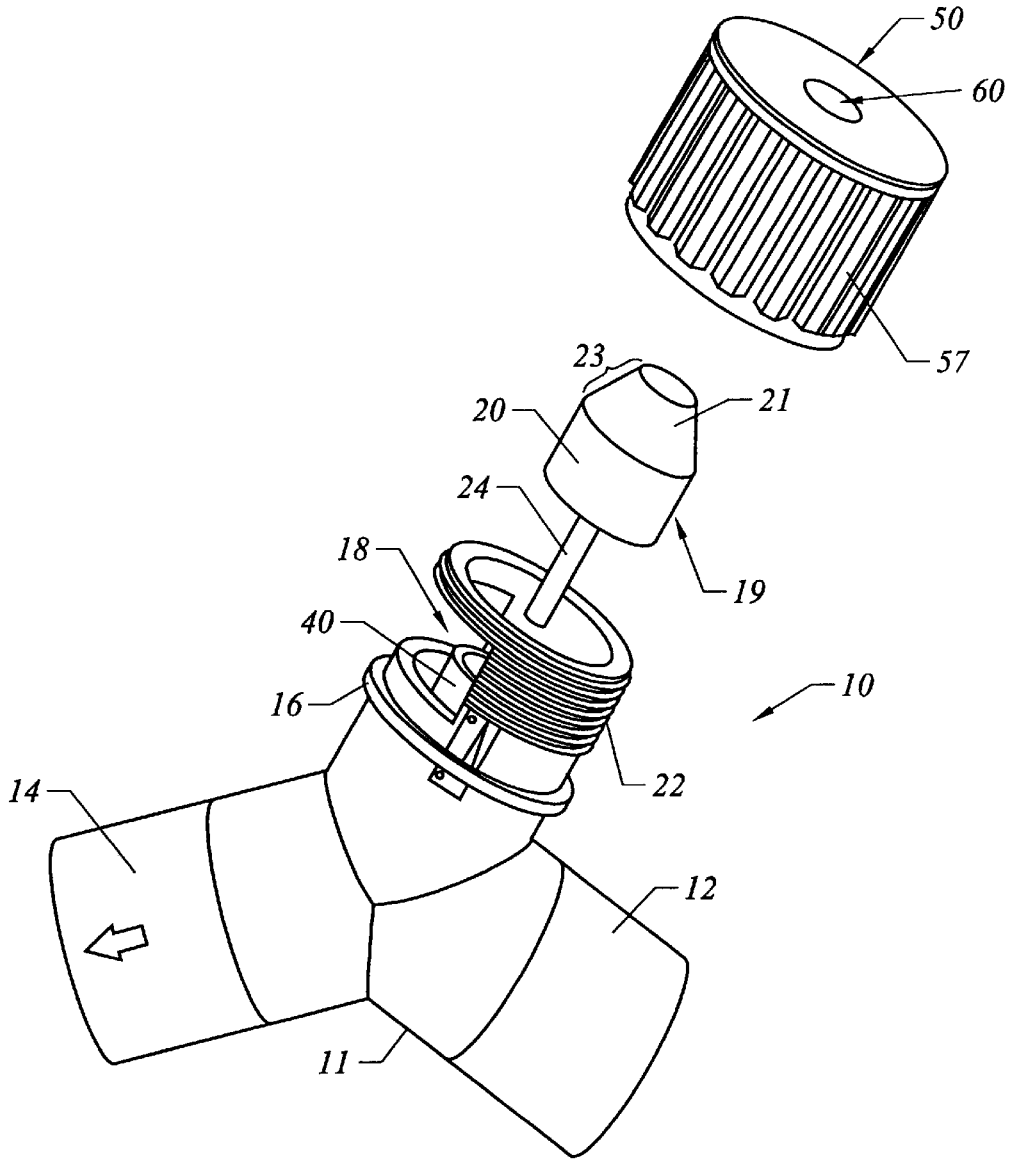
FIG. 1 is an exploded perspective view of the suction regulator of the present invention.

FIG. 1 shows a perspective view of a suction flow regulator 10 in accordance with the present invention. The flow regulator 10 includes a housing 11 having a y-shaped cross section formed by the intersection of three tubes, an inlet tube 12, an outlet tube 14 and a regulator tube 16. The housing 11 is designed to be coupled such that the inlet 12 is connected to a suction cleaner of a type such as that described in copending patent application Ser. No. 09/662,260 while the outlet 14 is coupled to a source of suction such as a skimmer pump or a pump specifically designed for use with the aforementioned pool cleaner. The regulator tube 16 includes a regulator assembly 19 including a valve 20 and a valve mount 40. The valve 20 has a generally cylindrical shape with a tapered edge 21 forming a partially conical section 23 of the valve 20. A tapered bore 60 in the regulator cap 50 receives the conical section 23 of the valve 20. The interior of the cap 50 includes threads (FIG. 7) to engage the threads 22 provided on the exterior of regulator housing 16. The regulator housing 16 includes a window 18 removed from a portion of the cylinder which allows additional water into the suction regulator 10 of the present invention as described below.

In operation, rotation of the cap 50 will allow water to enter the suction regulator through the window 18 and the tapered bore 60 in the cap 50 when the cap is rotated away from the intersection of the three cylindrical tubes. The suction force of the pump pulling water flow from the inlet to the outlet will be reduced as some of the suction force will be channeled into drawing water in through the inlets. The multiple inlets 60, 18 increase the amount of suction regulation per turn over the use of a single inlet.

Figure 3:
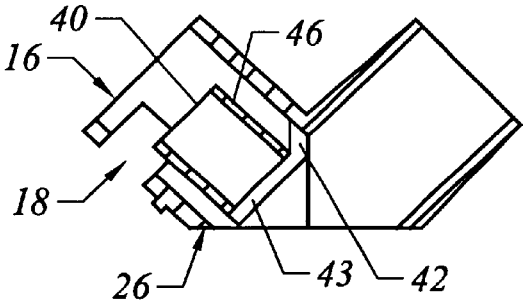
FIG. 3 is a cross section along line A—A in FIG. 2.
Figure 2:
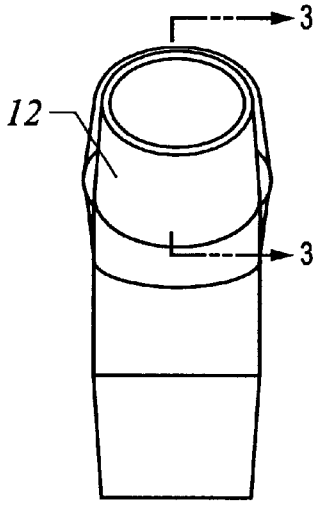
FIG. 2 is a first end view of the suction regulator of the present invention.

FIGS. 2 and 3 illustrate the valve mount 40 on the interior of the regulator housing. The valve mount 40 comprises a cylindrical mount secured to the interior of the suction regulator 10 by a lip 42. The valve mount 40, and the entire suction regulator housing 11 may be formed by injection molding plastic. The valve 20 includes a stem 24 adapted to slidably engage the valve mount 40 to allow the valve to rest on the interior of the regulator housing 16, while limiting movement of the valve beyond the base 43 of the valve mount 40.

Figure 4:
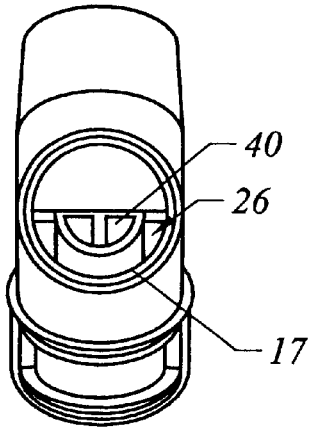
FIG. 4 is a second end view of the suction regulator of the present invention.

FIG. 4 illustrates the regulator housing 16 and the valve mount 110 from a perspective inverted with respect to FIG. 3. As shown in FIG. 4 the valve mount 40 and lip 42 limit the amount of water flow to the inlet and outlet by reducing the area allowed for water flow into the suction flow to the semicircular section 26 between the valve mount 40 and interior wall section 17 opposite the valve mount 40 in the regulator housing 16.

Figure 5:
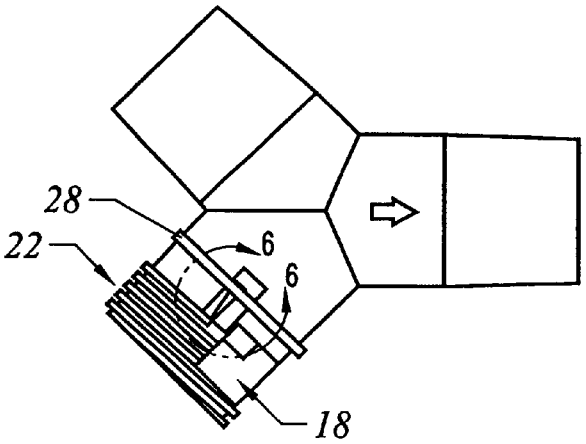
FIG. 5 is a side view of the suction regulator of the present invention.
Figure 6:
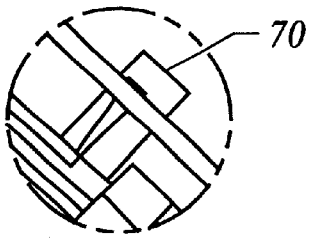
FIG. 6 is an enlarged view of detail area B in FIG. 5.

As shown in FIG. 5, the window 18 occupies a portion of the exterior threads 22 on regulator housing 16. A stop band 28 may be formed on the exterior of the regulator housing 16. As shown in FIG. 6, a suction regulation indicator 70 may be provided to indicate to the user of the flow regulator whether the amount of suction is "high," when the valve is fully closed, or "low" when the valve is fully or partially open, and the direction of rotation which raises or lowers the suction.

Figure 7:
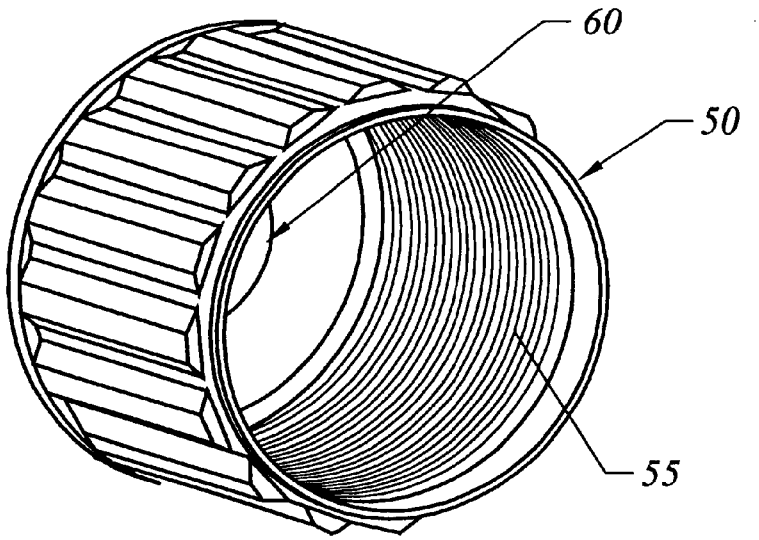
FIG. 7 is a perspective view of the cap of the suction regulator of the present invention.
Figure 8:
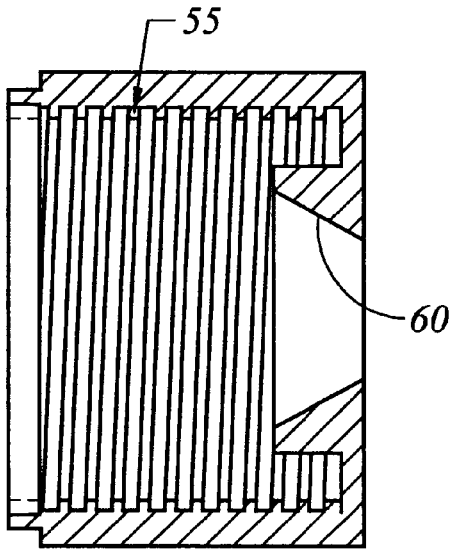
FIG. 8 is a side, cutaway view of the cap of the suction regulator of the present invention.

FIGS. 7 and 8 illustrate the cap 50 of the suction regulator 10 of the present invention. The cap has a generally cylindrical shape with an interior cross section slightly larger and designed to cooperate with the exterior of the regulator housing 16. As shown therein, the threaded bore 60 has a tapered edge 62 matching the tapered edge of the valve body 40, and the cap 50 includes threads 55 on the interior surface thereof which match the threads 22 on the exterior of the regulator housing 16. Sixteen equally-spaced grips 57 are formed in the exterior of the regulator housing.

When the cap 50 is rotated counterclockwise, the stop band 28 will prevent over-rotation of the cap 50 past the point when the cap 50 is fully tightened (which may be a problem when plastic is used to form the suction regulator as the threads can become stripped). When fully rotated, both the tapered bore 60 and the window 18 are sealed, providing maximum suction to the fluid flow through the inlet to the outlet.

The many features and advantages of the present invention will be readily apparent to one of average skill in the art. It should be readily recognized that alternate materials and manufacturing methods may be utilized to form different parts shown herein. All such features and modifications of the present invention are intended to be within the scope of the application as defined by the following claims.

What is claimed is:

1. A water flow control valve for a suction cleaning apparatus, comprising:

a y-shaped valve housing having an inlet, an outlet and a regulator tube;

a window positioned in the regulator tube;

a regulator mount positioned in the regulator tube;

a valve having a generally conical shape with a tapered end and a mount post positioned opposite the tapered end; and a regulator cap having a bore receiving the tapered end.

2. The water flow control valve of claim 1 wherein each said inlet, outlet and regulator tube is a generally cylindrical structure.

3. The water flow control valve of claim 1 wherein said regulator cap includes a plurality of threads engaging threads on the regulator tube, and wherein rotation of the regulator cap varies the amount of water entering said bore and said window.

4. The water control valve of claim 1 wherein said regulator mount and said regulator tube define a semi-cylindrical section within said regulator tube through which water entering the window and the bore passes to the inlet and outlet.

5. The water control valve of claim 1 wherein said valve and said regulator cap act in conjunction to vary the amount of water entering the regulator tube.

6. The water control valve of claim 1 wherein the regulator cap includes a plurality of threads and the regulator tube includes a plurality of corresponding threads, and the regulator cap engages the threads on the regulator tube to cover or uncover the window upon rotation of the regulator cap relative to the regulator tube.

7. A suction control valve, comprising:

an inlet and an outlet; and a suction regulator coupled between the inlet and the outlet, the suction regulator comprising:

a regulator housing having an opening;

a cylindrical valve in the regulator housing;

an adjustable housing cover capable of completely covering the opening.

8. The suction control valve of claim 7 wherein the outlet has a generally cylindrical cross-section, and the suction regulator has a generally cylindrical cross-section forming a Y-shaped suction control valve.

9. The suction control valve of claim 7 wherein the adjustable housing cover includes an inlet in the housing cover which is sealable by said cylindrical valve on movement of the housing cover.

10. The suction control valve of claim 7 wherein the adjustable housing cover threadably engages the suction regulator housing.

11. The suction control valve of claim 7 wherein the opening in the regulator and a central opening in the adjustable housing cover sealable by the cylindrical valve cooperate to allow water into a flow passing between the inlet and the outlet.

12. A suction control regulator for a suction cleaner, comprising:

a y-shaped housing having an inlet and an outlet, and a regulator section;

a valve mount positioned in the regulator section;

a valve having a stem adapted to be received in the valve mount;

a window in the regulator section; and a cap having a tapered bore engaging the valve, and threads adapted to engage the regulator section such that rotation of the cap seals or opens the window and the tapered bore.

13. The water control valve of claim 12 wherein the inlet, outlet and regulator section have a generally cylindrical structure.

14. The suction control regulator of claim 12 wherein the valve seals the tapered bore upon rotation of the cap.

15. The suction control regulator of claim 12 wherein the tapered bore and the window act in cooperation to allow water to access a fluid stream passing through said inlet and said outlet.

* * * * *